US011565295B2

(12) United States Patent
Guernsey et al.

(10) Patent No.: US 11,565,295 B2
(45) Date of Patent: Jan. 31, 2023

(54) ANGLE MEASUREMENT SYSTEM

(71) Applicant: Accurpress America Inc., Rapid City, SD (US)

(72) Inventors: Allen Guernsey, Rapid City, SD (US); Steve Hilton, Rapid City, SD (US)

(73) Assignee: ACCURPRESS AMERICA INC., Rapid City, SD (US)

( * ) Notice: Subject to any disclaimer, the term of this patent is extended or adjusted under 35 U.S.C. 154(b) by 27 days.

(21) Appl. No.: 16/578,188

(22) Filed: Sep. 20, 2019

(65) Prior Publication Data

US 2021/0086245 A1 Mar. 25, 2021

(51) Int. Cl.
*B21D 5/02* (2006.01)
*B21C 51/00* (2006.01)

(52) U.S. Cl.
CPC ..... *B21D 5/02* (2013.01); *B21C 51/00* (2013.01)

(58) Field of Classification Search
CPC ..... B21D 5/02; B21D 5/0209; B21D 5/006; B21D 5/004; B21D 5/002; B21C 51/00; G01B 3/56
USPC ..... 72/31.11; 33/534, 1 N
See application file for complete search history.

(56) References Cited

U.S. PATENT DOCUMENTS

| | | | | |
|---|---|---|---|---|
| 4,488,237 | A * | 12/1984 | Aronson | B21D 5/004 33/706 |
| 4,864,509 | A | 9/1989 | Somerville et al. | |
| 5,829,288 | A * | 11/1998 | Serruys | B21D 5/02 72/17.1 |
| 6,240,646 | B1 * | 6/2001 | Ronnmark | B21D 5/02 33/1 N |
| 7,249,478 | B2 * | 7/2007 | Takehara | B21D 5/02 72/20.1 |
| 7,802,456 | B2 * | 9/2010 | Ikeda | B21D 5/02 72/31.05 |
| 9,908,163 | B1 * | 3/2018 | Rose | G01B 11/26 |
| 10,365,091 | B2 * | 7/2019 | Wogerbauer | B21C 51/00 |

FOREIGN PATENT DOCUMENTS

EP 1 519 800 B1 8/2007

* cited by examiner

*Primary Examiner* — Shelley M Self
*Assistant Examiner* — Teresa A Guthrie
(74) *Attorney, Agent, or Firm* — Gordon Rees Scully Mansukhani, LLP

(57) ABSTRACT

A press brake machine for bending metal having an angle measurement system. The angle measurement system having at least one angle measurement device configured to measure the bend characteristics of the workpiece. The angle measurement device including an actuator, a position sensor, and a contact segment. The actuator of the measurement device is configured to abut the contact segment to the workpiece. The position sensor is configured to send data to a press brake controller to adjust the bending of the workpiece depending on the reading of the angle measurement device.

20 Claims, 8 Drawing Sheets

ANGLE MEASUREMENT SYSTEM

The application relates generally to press brake system, in particular, a measurement and adjustment system for a press brake.

A press brake machine or device is used as a tool to make precise bends in metal parts. Generally, a sheet of metal is placed within the machine and positioned precisely using a gauge. A punch is placed against the metal sheet at the point where a bend is required. The punch is pressed into the metal sheet, which in turn is pressed into a die causing the sheet to bend.

Accurate angle measurements for bends are highly desired in the field of metal bending. Typical angle measurement devices are large in size and are connected to the punch. Thus, these convention devices travel with the punch. These angle measurement devices may also be disposed within the die off the press brake machine. This arrangement requires that each angle measurement device be manufactured separately for each punch and die arrangement. Typical angle measurement devices also use lasers and cameras. These lasers are attached to back gauges and are too inaccurate to provide prompt measurements of the angle of the workpiece or sheet. Furthermore, lasers have a scan time requirement. In order to be accurate, the bending process has to stop in order for the cameras to receive accurate readings. The stopping and starting slow the bending process, favoring fewer readings. However, having too few measurements will be inaccurate. Thus, there is a need for improving angle measurements in the field of metal bending.

BRIEF DESCRIPTION OF THE DRAWINGS

Features, aspects, and advantages of the press brake machine and angle measurement device will become apparent from the following description, appended claims, and the accompanying exemplary embodiments shown in the drawings, which are briefly described below.

DETAILED DESCRIPTION

Figure 1A:
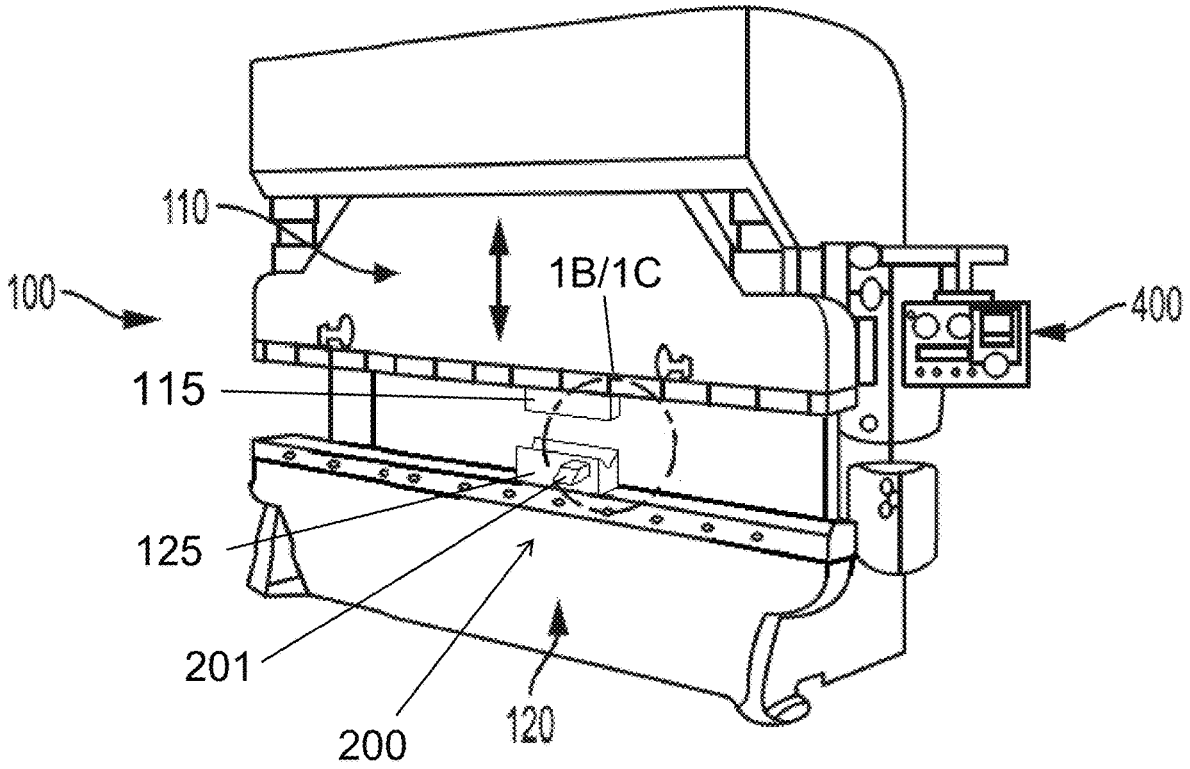
FIG. 1A is an isometric view of the press brake machine.

Various features of a press brake and an associated angle measurement device will be described with reference to the drawings. Like numbers are used throughout the drawings to refer to the same or similar parts and in each of the embodiments of the invention hereafter described.

The press brake machine described herein may be structured, for example, in the manner of the press brake machine disclosed in application Ser. No. 16/541,021, filed on Aug. 14, 2019 (incorporated by reference herein in its entirety). An exemplary press brake machine may include a ram located above a bed. The machine may include one or more hydraulic cylinders that force the ram (and a connected punch) downward toward the bed (and a connected die).

Alternatively, the force of hydraulic pressure may be used to force the bed upward. The press brake machine processes a workpiece (e.g., sheet metal) through bending the workpiece to a desired shape.

To provide high precision bending, an angle measurement system is located on and/or adjacent to the die of the press brake machine. The angle measurement system includes at least one angle measurement device that includes a piston and a pneumatic actuator disposed in a device housing. The angle measurement system may include multiple measurement devices that are placed along the length of the press brake machine.

During the bending process, the piston pushes a contact segment disposed on top of the piston against the workpiece as the punch of the press brake machine abuts the workpiece. The angle measurement device may also measure inconsistencies and variations of the workpiece thickness. When the position of the piston of the angle measurement device pauses or changes direction (i.e., moves inward into a corresponding hydraulic cylinder), measurements are taken of the position of the punch and the position of the contact segment of the angle measurement device. The relative distance between the punch position and the contact segment position correlates to the workpiece thickness. The angle measurement system may be calibrated in order to provide correct sensor measurements. The calibration may be done with a calibration workpiece or by having a reference data input to a press brake controller. The linear displacement of the piston and/or piston rod may be measured using a linear potentiometer. Many types of sensors may be used to measure the position of the piston and or a sensor rod. For example, any one of the following types of sensors may be used: capacitance sensor; linear transducer type sensor, eddy current sensor, photoelectric sensor; hall-effect sensors, and ultrasonic sensors.

The press brake controller may communicate with the different systems of the press brake such as the hydraulic cylinders of the ram, crowning system, and the angle measurement system. The controller may also provide signals to a user interface to allow the user to control of the press brake machine and change the parameters of the press brake machine such as bend angle. The controller may be configured to have set points for each of the angle measurement devices so that the press back machine may be operated to achieve the desired bend angle in the workpiece. The setpoints for the bend angles may also be stored in each of the angle measurement devices. Different bend angles may be set for different angle measurement devices along the length of the press brake to enable bending and fabrication of complex workpieces.

When the initial bend is made by the punch, the workpiece will typically experience a springback. Springback occurs when the workpiece reverses the bend and attempts to return to its original shape after being bent due to the elastic property of the workpiece. The angle measurement system may be used to measure springback of the workpiece. The change in angle measurement resulting from springback of the workpiece may be provided to the controller. The control system for the press brake machine may operate the press brake machine to bend the workpiece again in an amount necessary to compensate for the springback.

The angle measurement system may determine the grain direction of the material. When bending with the grain the inside bend radius is different then when bending across the grain. By calculating the change of the inside radius, the grain direction can be determined, and adjustments can be made. Also, by employing angle measurement devices positioned along the length of the punch/die and workpiece the angle measurement system may provide data necessary to determine any variations in angle along different lengths of the bend line. For example, the system may be operated to ensure that the variation in bend angle along the length of the bend line is minimized. Variations in bend angle may be automatically compensated for, which results in consistent angle performance. Grain direction affects the angle of the bend at specific orientations. By calculating the current bend angle and comparing it to the expected angle based on the inside bend radius, grain direction can be calculated and compensated for.

The press brake machine may include a crowning system to compensate for the inherent deflection that occurs along the length of the ram and table of the press brake machine when load is applied, especially for long or higher tonnage press brakes. Typically, the crowning system raises the lower bed such that the lower portion of the machine (lower bed and die) is parallel to the upper portion of the machine (ram and punch). The angle measurement device measures the machine deflection in real-time and automatically updates the system for the next bend, thus eliminating the need for a separate crowning sensor used to control the position of the bed or ram. The bend angles detected along the length of the workpiece by the angle measurement system may be used to control the crowning system to adjust the lower bed or adjust the Y1/Y2 (ends of the upper ram) of the press brake machine.

The angle measurement device may also include a pneumatic line, and an actuator valve. The actuator valve controls the flow of air used in the actuation of the piston. The actuator valve is disposed inside the housing of the angle measurement device and located within the air line (e.g., a pneumatic line). Each angle measurement device employed in the angle measurement system may include a single input/output cable for housing an electrical power line, a data input/output line and the air line.

FIG. 1A illustrates a press brake machine 100. The press brake machine disclosed herein is used to bend or otherwise deform sheet-like workpieces, such as sheet metal workpieces (not shown). The press brake machine may include an angle measurement sensor system 200, comprising one or more angle measurement devices 201 (only one side shown). The press brake machine is controlled via the press brake controller 400. The controller may be operated manually by a user or autonomously in an unmanned operation. The controller may also be used to control the movement of the workpiece and any tools associated with the press break machine. The forward and back gauges (not shown) aid unmanned operation of the press brake system of the press brake system by ensuring the proper positioning of the workpiece. These gauges may, for example, utilize the system disclosed in U.S. Published Patent Application No. 2018/0133771, Ser. No. 15/814,158 filed on Nov. 15, 2017 (incorporated by reference herein in its entirety). The press brake machine 100 has an upper beam or ram 110 and a lower beam or bed 120, at least one of which is movable toward and away from the other. Preferably, the upper beam is movable vertically while the lower beam is fixed in a stationary position. As an example, a male forming punch and a female forming die may be mounted respectively on the upper and lower beams of a press brake. Although generally fixed, the position of the lower beam may be adjusted through use of crowning system to ensure consistent bending of longer workpieces.

Figure 1B:
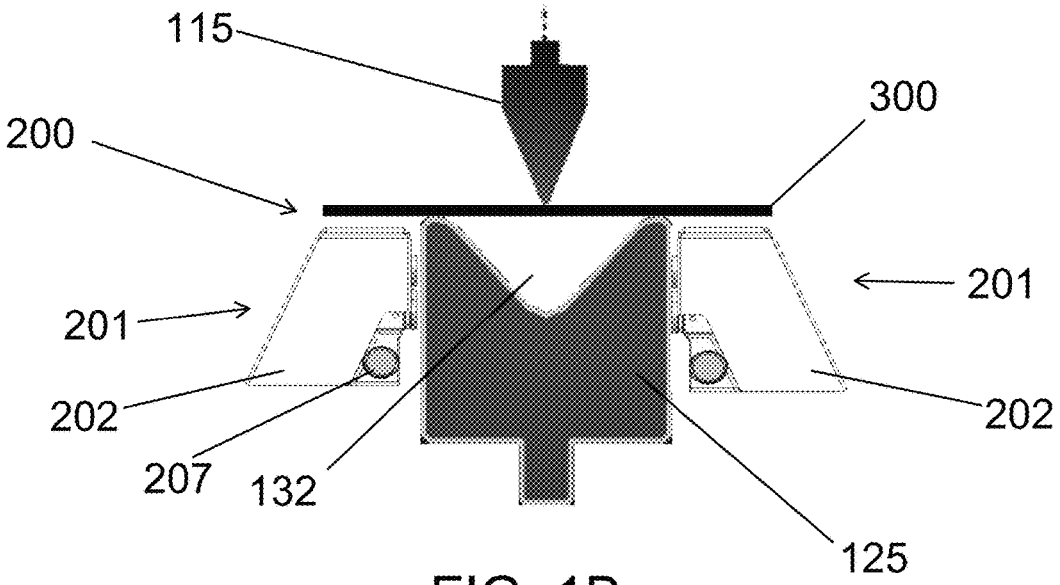
FIG. 1B is a close up view of the press brake machine.
Figure 1C:
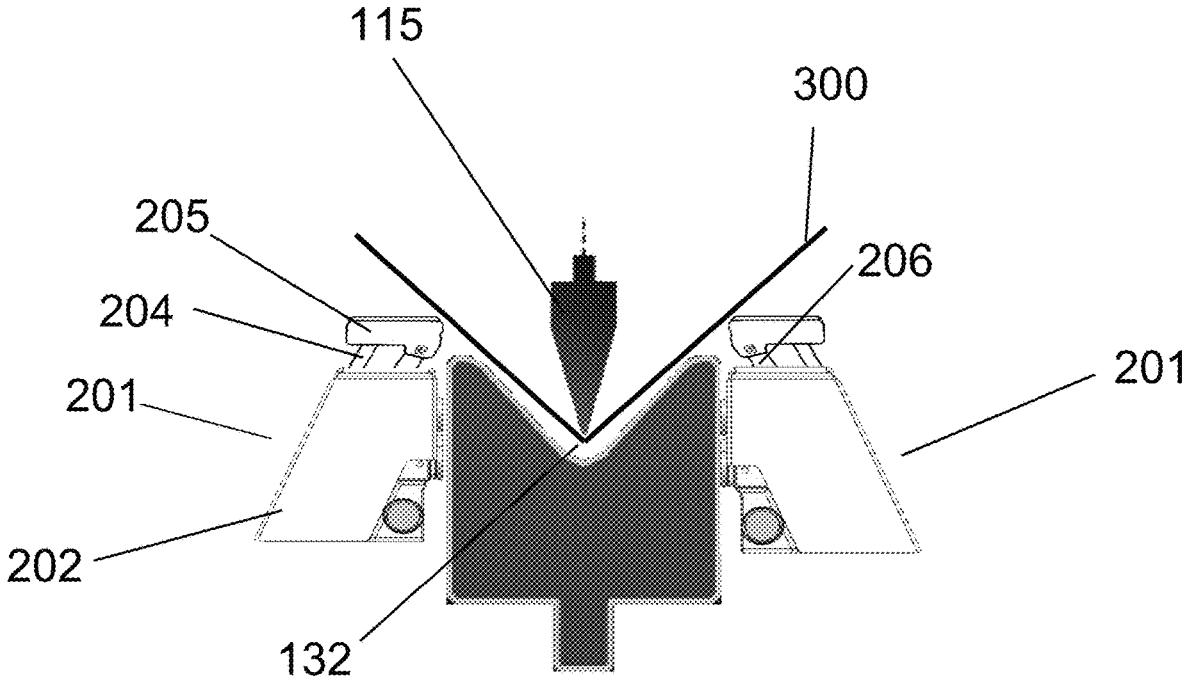
FIG. 1C is a close up view of the press brake machine during a bend.
Figure 2:
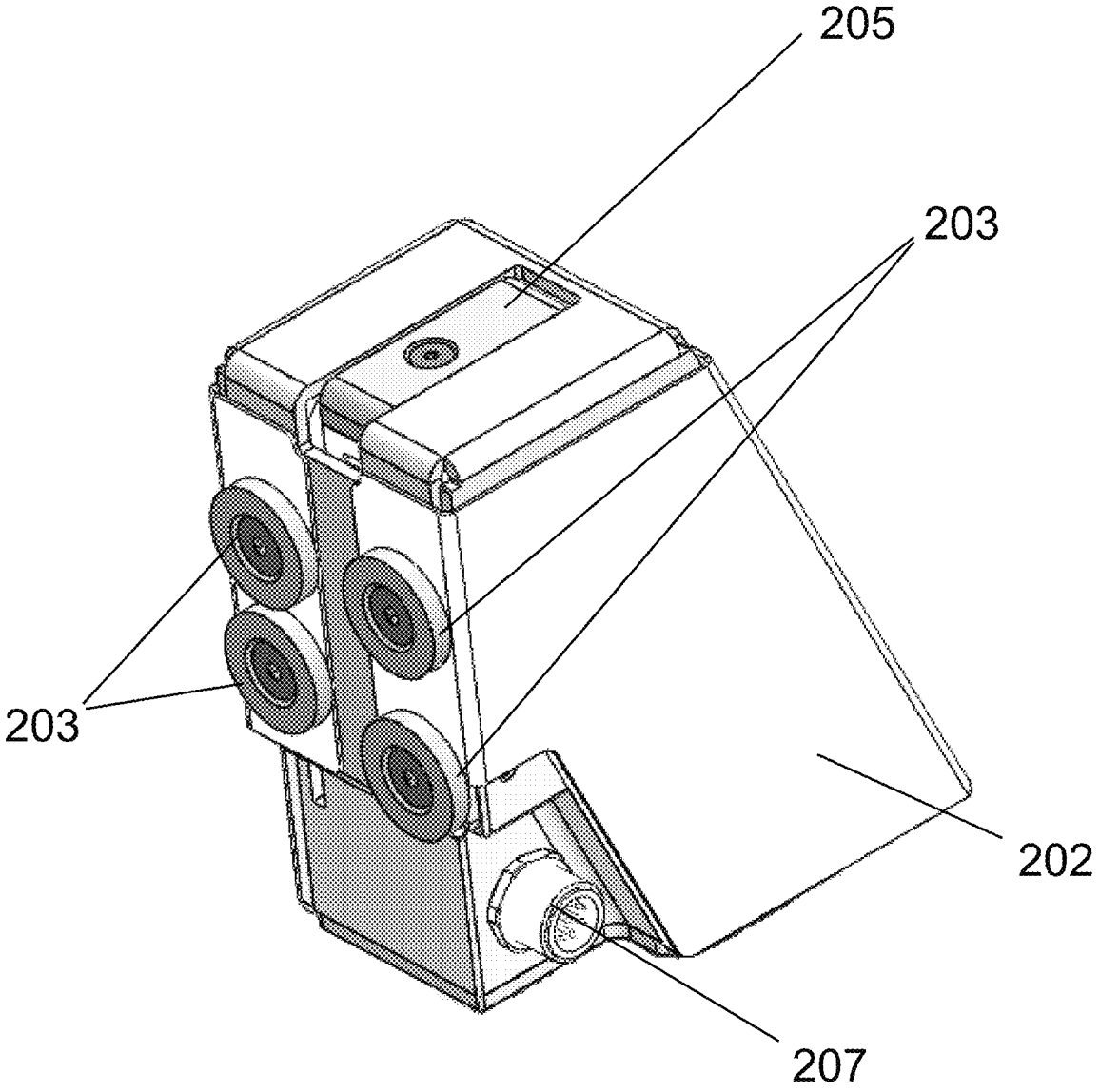
FIG. 2 is an isometric view of an angular measurement device.
Figure 3:
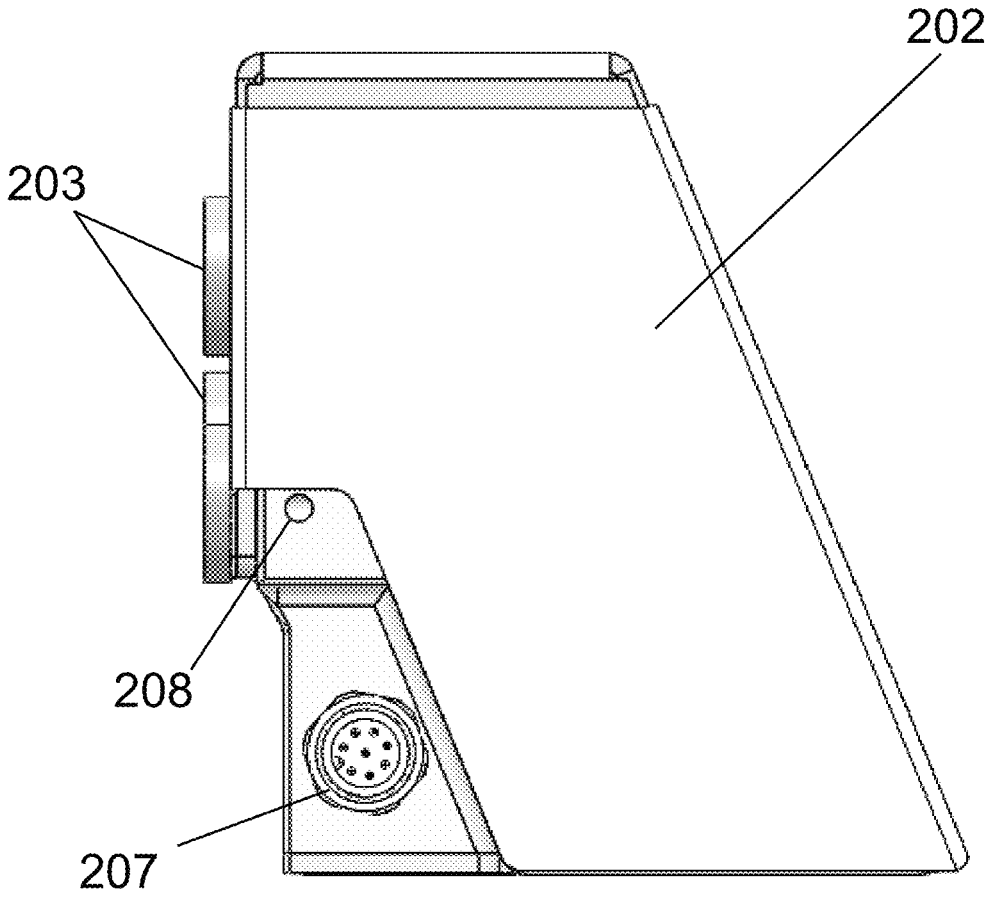
FIG. 3 is a side view of the angular measurement device.
Figure 4:
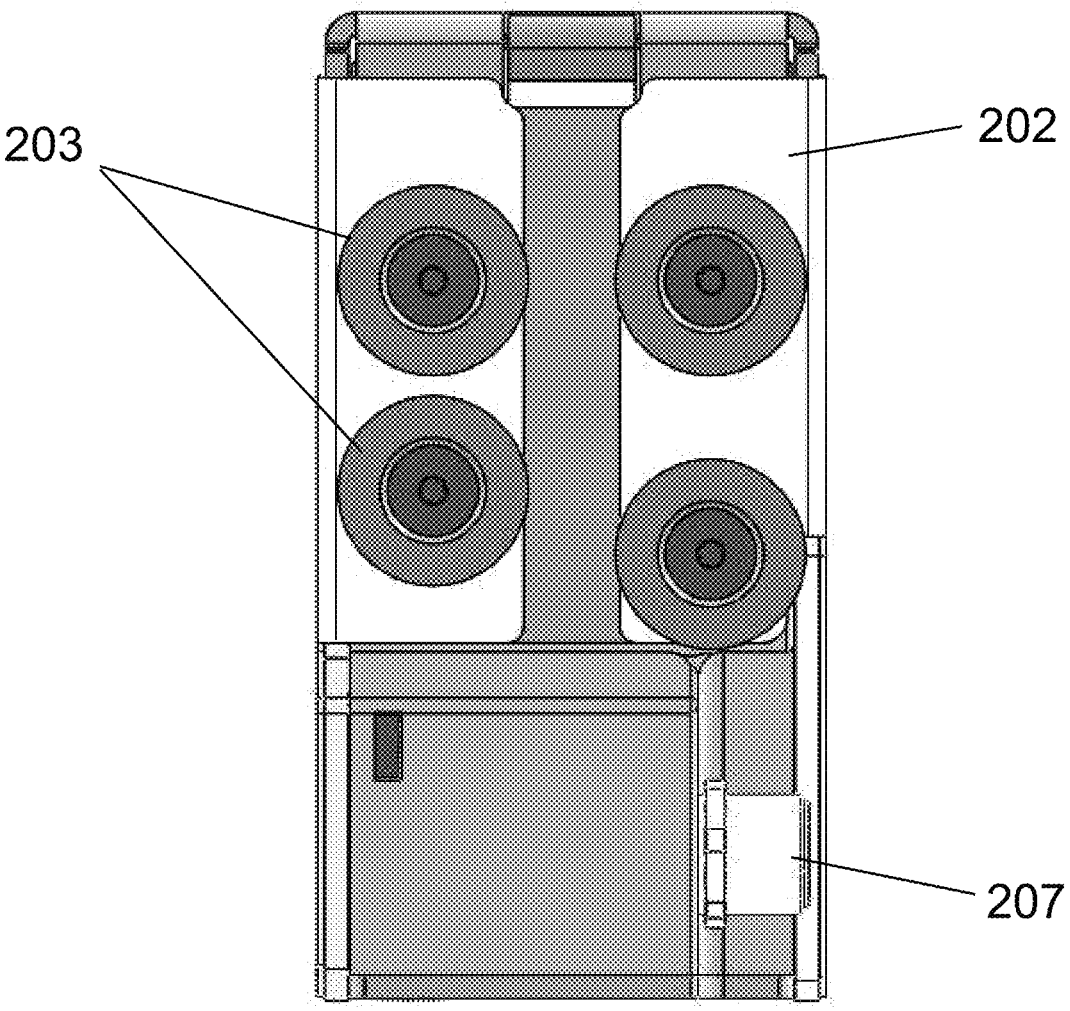
FIG. 4 is a front view of the angular measurement device.
Figure 5:
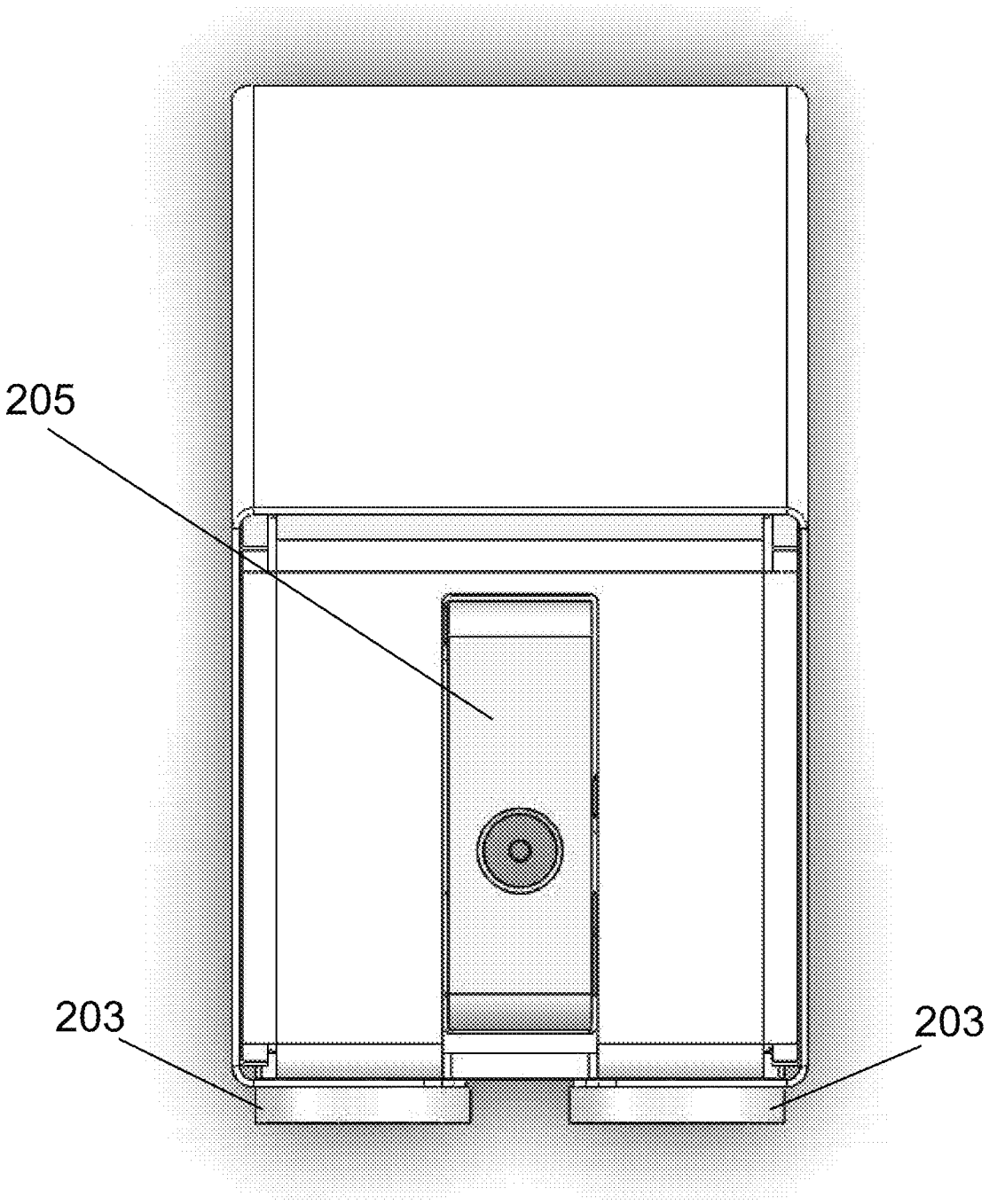
FIG. 5 is a top view of the angular measurement device.
Figure 6:
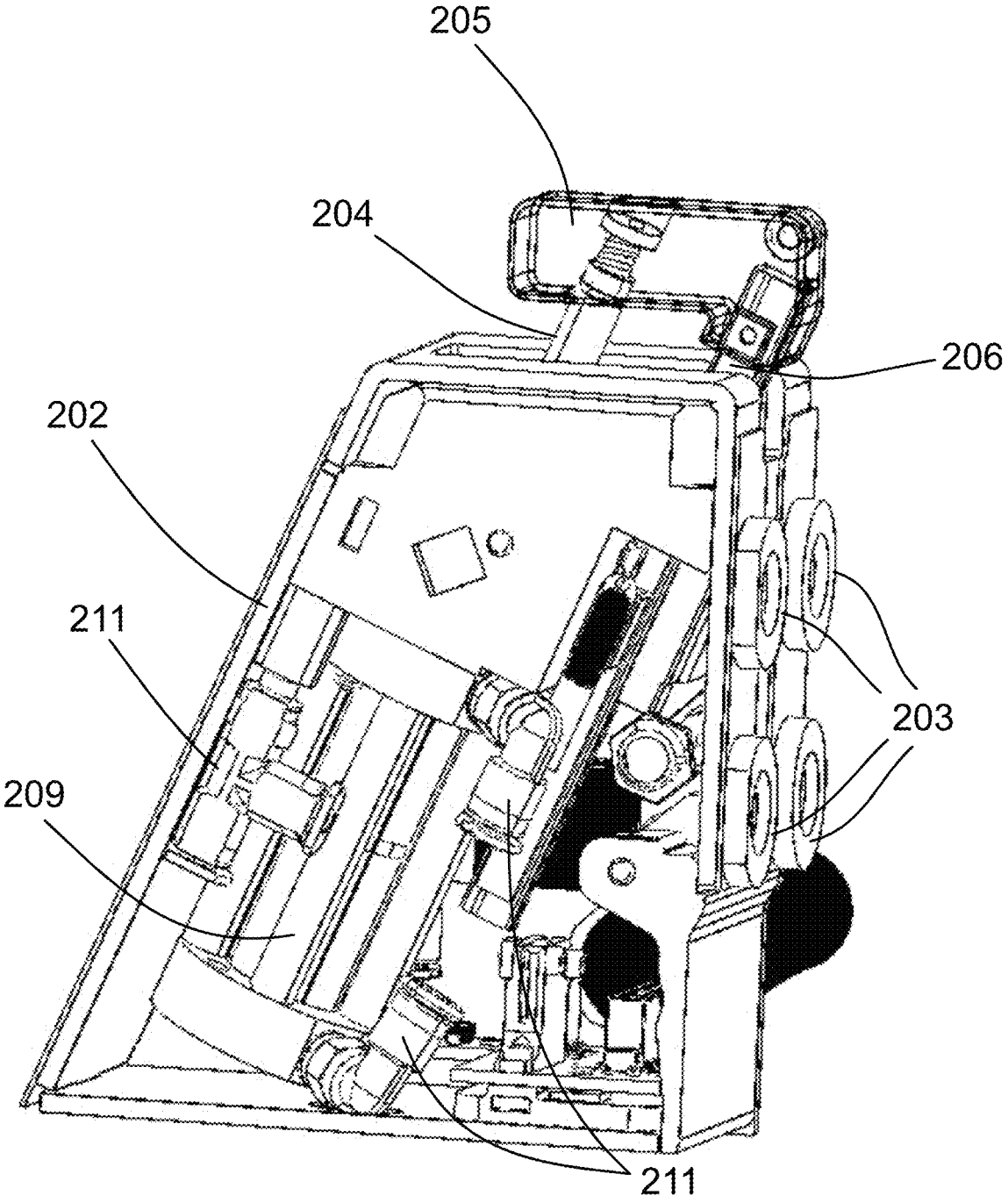
FIG. 6 is a sectional view of the angular measurement device.
Figure 7:
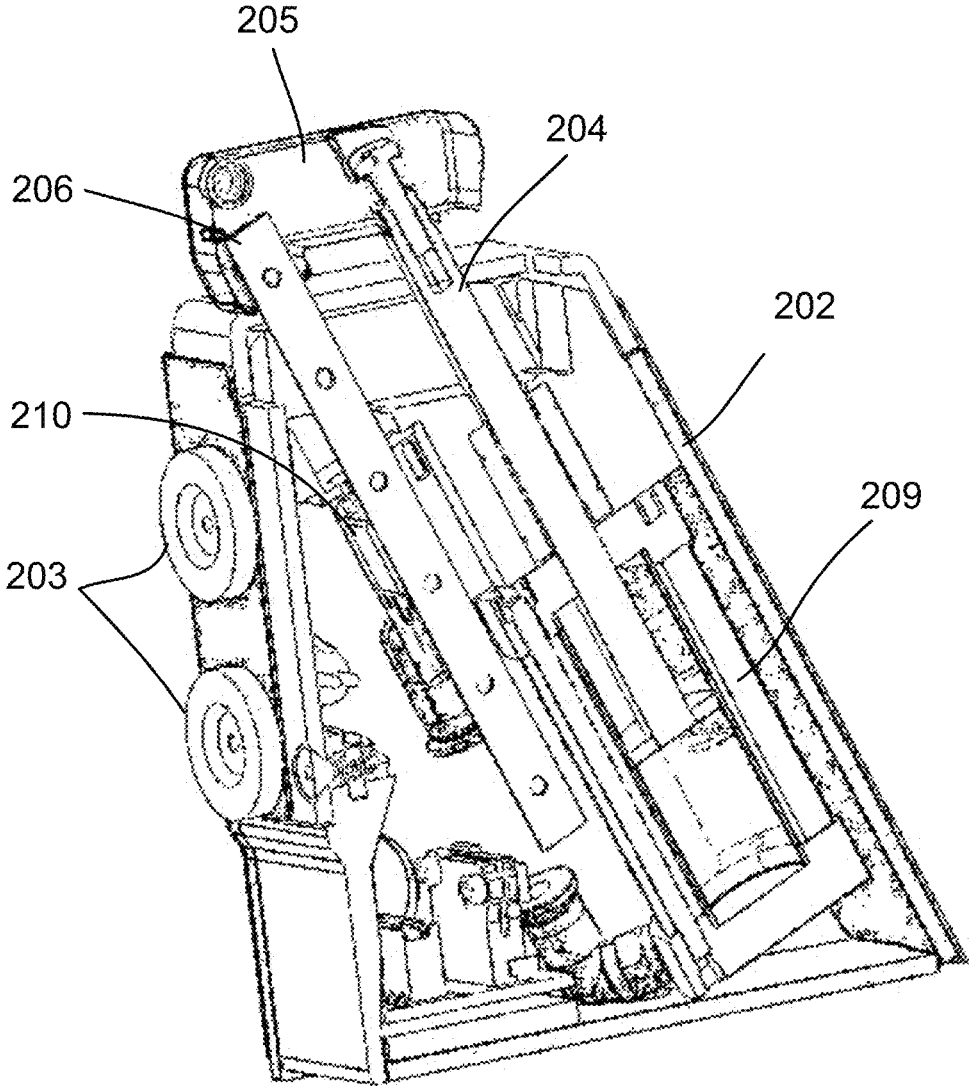
FIG. 7 is a sectional view of the angular measurement device.

As shown in the close up views provided in FIGS. 1B and 1C, the punch 115 projects downward into the die 125. The exemplary die and punch combination shown is a "V" die, however other die shapes such as a "U" die may be used. Angle measurement devices 201 are located on the lateral sides of the die 125. Each angle measurement device 201 includes a housing 202 which houses components that will be discussed below. The angle measurement device 201 may include magnets 203 that attach the device 201 to the die 125. Multiple angle measurement devices 201 may be placed along the length of the die 125. The press brake machine 100 may also include multiple dies each with at least one angle measurement device 201. The workpiece 300 is disposed above the die and below punch 115. The punch 115 includes a workpiece deforming surface at the tip of punch 115. The configuration of this surface is dictated by the shape into which it is desired to deform a workpiece 100. The die includes a recess 132 into which the work deforming surface of the punch 115 is driven. The configuration of this recess 132 may correspond to the configuration of the punch's tip. Thus, when the upper and lower beams are brought together, a workpiece 300 located between them is pressed by the punch into the die to give the workpiece a desired deformation (e.g., a desired bend).

In order to create accurate bends, the angle measurement system 200 measures the angle at various locations of the workpiece 300 througout the bending process via one or more angle measurement devices 201. The angle measurement system 200 may be controlled by a separate controller or, preferably, by the press brake controller 400. The press brake controller 400 is configured to receive data from the angle measurement devices 201 in order to calculate and measure dimensions and angles pertinent to the fabrication process, such as the bend angle of the workpiece. The dimensions and angles of the workpiece may be measured as a function of the position of the contacting segment 205 and a sensor rod 206. The piston 204 and the sensor rod 206 are attached to a contacting segment 205. The contacting segment 205 is configured to abut and contact the workpiece 300 during the bending process. Upon contact of the punch 115 to the workpiece, the controller may receive inputs from the angle measurement system 200 regarding the height of the contacting segment 205 and the height of the punch 115 to measure thickness of the workpiece 300. The position of the punch is recorded as soon as the contacting segment 205 moves in tandem with the bend in the upwards direction. The thickness of the workpiece affects the characteristic of the bend, such as the minimum bend radius (radius of the inside bend). The operation of the press brake machine may be adjusted by the controller to accommodate for the measured thickness of the workpiece and provide for movement of the punch or die that yields the most optimal bending.

The angle measurement system 200 may be employed to measure springback of the workpiece. The bend angle after springback occurs may be detected by the angle measurement device and a signal may be provided to the controller of the press brake machine so that the amount of springback may be calculated and the press brake machine may bend the material in a manner to compensate for the springback. For example, an additional amount of bending may be provided so that after springback the desired bend angle is achieved. To measure springback the ram and punch 115 will bend the workpiece 300 to a desired bend angle. The angle measurement system will record this angle, then the ram and punch 115 will reverse and let the springback occur, in which the angle measurement devices 201 will measure the new angle after the springback. The angle difference is then determined in the controller and compensated for in the bend of the workpiece 300 by the controller 400.

The angle measurement system may also be able to detect variations of the inside bend radius required to cause bending depending on whether the bending occurs with or against the material grain of the workpiece. Variations can be automatically compensated for, which results in consistent angle measurements in the bends. Grain direction affects the angle of the bend at specific orientations. By calculating the current bend angle and comparing it to the expected angle, grain direction can be calculated and compensated for in the bending process by the controller 400.

The angle measurement system also can detect variations along the length of the bend line though the use of a plurality of angle measurement devices 201. These variations may result for variations in the grain of the workpiece as discussed above, or for other reasons associated with tolerances or inconsistencies in the workpiece or the operation of the press brake system. The press brake system may be operated to ensure that the variation in bend angle along the length of the bend line is minimized. Variations in bend angle may be automatically compensated for by adjusting the position of the punch and/or die along the length of the bend line, which results in consistent angles along the length of the bend line.

The press brake machine may include a crowning system (not shown) to compensate for the inherent deflection that occurs along the length of the ram and table of the press brake machine when load is applied, especially for long or higher tonnage press brakes. Typically, the crowning system raises the lower bed (typically around the midpoint of the longitudinal length of the lower bed) such that the lower portion of the machine (lower bed and die) remains parallel to the upper portion of the machine (ram and punch) when bending long workpieces. The angle measurement device measures the machine deflection (i.e., the die position) in real-time and automatically updates the system for the next bend, thus eliminating the need for the crowning sensor for separately detecting the position of the lower bed and/or die. The angle measurement system may be configured to provide data to the control system for the crowning system to adjust the lower bed or adjust the Y1/Y2 (left/right ends of the upper ram) of the press brake machine.

The use of a controller 400 on the press brake provides for reduced time and improved efficiency of bending operations for even relatively simple bending of parts that include only two or three bends and for lots of parts that only include two or three parts.

The controller may include a display and user interface that, for example, provides the user with a graphical representation of the formed part in a simple to use format. The controller preferably includes software that a user may interface with, via the user interface (e.g., a display or a keyboard), to control forming operations of the workpiece. The user may input various information through the user interface such as, for example, the material type, thickness, length and describing the bends and flange lengths. The controller may be configured to control the position and speed of all the axis of the machine. The controller may further control the press brake machine based on the angle measurement system 200 and the devices 201. Thus, the controller reduces the setup time and operator experience required for bending various parts. In addition, the use of the controller may reduce the amount of scrap material that remains after the bending operation. According to one embodiment of a press brake machine, the forward and or rear gauges of the machine may include one or controllable axis. The gauges may include two or more clamps located at the end of an arm which may grasp a workpiece and act as material stops and supports which allow for accurate gauging (i.e., positioning) of workpieces.

FIGS. 2-7 disclose an embodiment of the angle measurement device 201. The angle measurement device includes the housing 202. Magnets 203 may be disposed on the exterior of the housing 202. The magnets 203 may be positioned to allow the housing 202 to attach to the die of the press brake machine. The angle measurement device 201 also includes an electrical data port 207 configured to receive and send data along with receiving electrical power to power the internals of the angle measurement device. The housing 202 also includes a pneumatic line port 208 configured for a pneumatic line to provide the angle measurement device pressurized air to be utilized for the device actuator 209 (see sectional drawings FIGS. 6 and 7). Pressurized air is communicated through the pneumatic line (not shown) to the pneumatic connectors to operate actuator 209. Actuator 209 is configured to move the piston 204 to allow contacting segment 205.

A position sensor 210 may be provided to sense the axial position of the sensor rod 206. The position sensor 210 sends data to the controller 400 to be analyzed and used for controlling operation of the pressbrake while working the workpiece. The position sensor 210 may be a linear potentiometer. The actuator 209 will actuate the piston 204 until the contacting segment 205 abuts and contacts the workpiece 300. A pressure transducer (not shown) may be utilized to sense the abutment and contact of the contact segment 205 with the workpiece. Upon contacting the workpiece, an actuator valve (not shown) controls air supply to the actuator 209, and the position of the sensor rod is detected the position sensor 210. The position sensor 210 provides data to the press brake controller 400. Different dimensions of the workpiece and bend may be determined based on the data collected by the position sensor 210 data such as the bend angle, workpiece spring back, and material thickness. The controller 400 uses the measurements and modify the bending process to produce an accurate and optimal bending process of the workpiece.

The angle measurement system may include multiple measurement devices that are placed along the length of the press brake machine along the length of the die. The angle measurement devices may be placed on both sides of the side such that the measurement devices are symmetric. The dies may also be segmented and the angle measurement devices may be placed such that at least one angle measurement device is placed on each segment.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to any precise numerical ranges provided. Accordingly, these terms should be interpreted as indicating that insubstantial or inconsequential modifications or alterations of the subject matter described are considered to be within the scope of the invention.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or movable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "fore," "aft," "inboard," "outboard," etc.) are merely used to describe the orientation of various elements in the figures. It should be noted that the orientation of various elements may differ according to other exemplary embodiments, and that such variations are intended to be encompassed by the present disclosure.

It is important to note that the construction and arrangement of the press brake system shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An angle measurement device for a press brake machine having a die and a punch configured to bend a workpiece by forcing the punch and die closer together so that the workpiece bends within a recess of the die, the angle measurement device comprising:

a device housing, wherein the device housing surrounds a device cavity, wherein the device housing comprises a contact segment configured to move toward the workpiece while remaining completely above and outside of the recess and abut and contact the workpiece at a single location above the recess and the die, wherein the workpiece is configured to be pressed by the punch into the die of the press brake machine;

an actuator configured to move a piston attached to the contact segment, allowing the actuation of the piston and the contact segment, wherein the actuator is located in the device cavity; and a position sensor located in the device cavity, wherein the position sensor comprises a sensor rod attached to the contact segment and wherein the position sensor detects the position of the sensor rod when the contact segment abuts and contacts the workpiece.

2. The device of claim 1, wherein data representative of the position of the sensor rod, recorded by the position sensor, is sent to a controller of the press brake, wherein the controller is configured to process the data to provide a measurement of the workpiece.

3. The device of claim 2, wherein the measurement is the thickness of the workpiece.

4. The device of claim 2, wherein the measurement is a bend angle of the workpiece, wherein the bend angle is defined as the angle of two segments of the workpiece after the punch presses the workpiece into the die.

5. The device claim of claim 1, further comprising magnets configured to attach to the die of the press brake machine.

6. The device of claim 1, wherein the actuator is a pneumatic actuator coupled to a pneumatic line.

7. The device of claim 6, wherein the actuator is coupled to an actuator valve configured to control the actuator.

8. A press brake configured to bend a workpiece comprising:

an upper beam having a punch;

a lower bed having a die;

wherein the upper beam is configured to press the punch to the workpiece and into a recess of the die to bend the workpiece; and an angle measurement system including a first angle measurement device connected to the die and comprising:

a first device housing, wherein the first device housing surrounds a first device cavity, wherein the first device housing comprises a first contact segment configured to move toward the workpiece while remaining completely above and outside of the recess and abut and contact the workpiece at a single location above the recess and the die, wherein the workpiece is configured to be pressed by the punch into the die of the press brake machine;

a first actuator configured to move a first piston attached to the first contact segment, allowing the actuation of the first piston and the first contact segment, wherein the first actuator is located in the first device cavity; and a first position sensor located in the first device cavity, wherein the first position sensor comprises a first sensor rod attached to the first contact segment and wherein the first position sensor is configured to record the position of the first sensor rod when the first contact segment abuts and contacts the workpiece.

9. The press brake of claim 8, wherein data representative of the position of the first sensor rod is provided to a controller by the first position sensor, wherein the controller is configured to process the data to provide a measurement of the workpiece.

10. The press brake of claim 9, wherein the measurement is the thickness of the workpiece, wherein the thickness of the workpiece is calculated using the position of the sensor rod and the position of the punch.

11. The press brake of claim 9, wherein the measurement is a bend angle of the workpiece, wherein the bend angle is defined as the angle of two segments of the workpiece after the punch presses the workpiece into the die.

12. The press brake of claim 8, the first angle measurement device further comprising magnets configured to attach to the die of the press brake machine.

13. The press brake of claim 8, wherein the actuator is a pneumatic actuator coupled to a pneumatic line.

14. The press brake of claim 13, wherein the actuator is coupled to an actuator valve configured to control the actuator.

15. The press brake of claim 8, further including a second angle measurement device comprising:

a second device housing, wherein the second device housing surrounds a second device cavity, wherein the second device housing comprises a second contact segment configured to abut and contact the workpiece;

a second actuator configured to move a second piston attached to the second contact segment, allowing the actuation of the second piston and the second contact segment, wherein the second actuator is located in the second device cavity; and a second position sensor located in the second device cavity, wherein the second position sensor comprises a second sensor rod attached to the second contact segment and wherein the second position sensor is configured to detect the position of the second sensor rod when the second contact segment abuts and contacts the workpiece.

16. The press brake of claim 15, wherein the first and second angle measurement devices are located on a first lateral side of the die and a second lateral side opposite to the first lateral side, respectively.

17. A press brake configured to bend a workpiece comprising:

an upper beam having a punch;

a lower bed having a die, the die having a length;

wherein the upper beam is configured to press the punch toward the workpiece and into a recess of the die in order to bend the workpiece; and a plurality of angle measurement devices, each angle measurement device connected to the die and comprising:

a device housing, wherein the device housing surrounds a device cavity, wherein the device housing comprises a contact segment configured to move toward the workpiece while remaining completely above and outside of the recess and abut and contact the workpiece at a single location above the recess and the die, wherein the workpiece is configured to be pressed by the punch into the die of the press brake machine;

an actuator configured to move a piston attached to the contact segment, allowing the actuation of the piston and the contact segment, wherein the actuator is located in the device cavity; and a position sensor located in the device cavity, wherein the position sensor comprises a sensor rod attached to the contact segment and wherein the position sensor is configured to detect the position of the sensor rod when the contact segment abuts and contacts the workpiece; and wherein the plurality of angle measurement devices are disposed along the length of the die.

18. The press brake of claim 17, wherein the plurality of angle measurement devices is disposed in a row on two lateral sides of the die along the length of the die.

19. The press brake of claim 17, wherein data representative of the position of each of the sensor rods of the plurality of angle measurement devices is provided to a controller by the position sensors, wherein the controller is configured to process the data to provide measurements of the workpiece.

20. The press brake of claim 19, wherein the controller adjusts the bending of the workpiece based on the position reading of the plurality of angle measurement devices.

* * * * *